US007763786B2

(12) United States Patent
Jones et al.

(10) Patent No.: US 7,763,786 B2
(45) Date of Patent: Jul. 27, 2010

(54) UNITARY FINGERBOARD AND METHOD OF MAKING SAME

(76) Inventors: Donald B. Jones, 1520 Granger Ave., Ann Arbor, MI (US) 48104; Douglas D. Jones, 1520 Granger Ave., Ann Arbor, MI (US) 48104

( * ) Notice: Subject to any disclaimer, the term of this patent is extended or adjusted under 35 U.S.C. 154(b) by 4 days.

(21) Appl. No.: 12/105,836

(22) Filed: Apr. 18, 2008

(65) Prior Publication Data

US 2008/0190264 A1 Aug. 14, 2008

Related U.S. Application Data

(63) Continuation-in-part of application No. 11/273,682, filed on Nov. 14, 2005.

(60) Provisional application No. 60/627,567, filed on Nov. 12, 2004.

(51) Int. Cl.
*G10D 3/06* (2006.01)

(52) U.S. Cl. ..... 84/314 R

(58) Field of Classification Search ..... 84/314 R
See application file for complete search history.

(56) References Cited

U.S. PATENT DOCUMENTS 1,472,943 A * 11/1923 Shaeffer ..... 84/314 R
2,497,116 A * 2/1950 Dopyera ..... 84/293
2,561,551 A * 7/1951 Allen ..... 84/723
2,795,988 A * 6/1957 MacCaferri ..... 84/293
2,816,469 A * 12/1957 Hutchison ..... 84/293
3,481,238 A * 12/1969 Veres ..... 84/267
3,538,807 A * 11/1970 Francis ..... 84/267
3,657,462 A * 4/1972 Robinson ..... 84/723
3,787,600 A * 1/1974 Muncy ..... 84/314 R
3,833,751 A * 9/1974 Chapman ..... 84/726
4,064,780 A * 12/1977 Bond ..... 84/314 R
4,221,151 A * 9/1980 Barth ..... 84/314 R
4,240,319 A * 12/1980 Soupios ..... 84/263
4,343,838 A * 8/1982 Baker ..... 427/292
4,359,923 A * 11/1982 Brunet ..... 84/267
4,530,268 A 7/1985 Starrett
4,633,754 A 1/1987 Chapman
4,950,437 A 8/1990 Lieber (Continued)

OTHER PUBLICATIONS

A revue of the legendary Veleno aluminum guitars, viewed at www.veleno.net/history2.html, viewed Dec. 24, 2009, instruments made from 1966 to 1976 by John Veleno.*

*Primary Examiner*—Jeffrey Donels
*Assistant Examiner*—Robert W Horn
(74) *Attorney, Agent, or Firm*—Brinks Hofer Gilson & Lione

(57) ABSTRACT

A stringed musical instrument has a head assembly, a tail, and an elongate neck extending from the head assembly to the tail. The neck defines a fingerboard having a surface layer and a substrate. The surface layer includes an exposed surface formed of sheet metal deformed to unitarily define a plurality of frets thereon. A plurality of strings extends from the head assembly along the neck and adjacent to the fingerboard. In another variation, the surface layer has an exposed surface unitarily defining frets thereon. Each fret forms a peak, and the surface layer defines a plurality of troughs separated by the peaks. Each trough has a single arcuate shape extending between each peak. A method of forming the stringed musical instrument is also disclosed.

20 Claims, 11 Drawing Sheets

U.S. PATENT DOCUMENTS

| | | | | |
|---|---|---|---|---|
| 4,987,816 | A * | 1/1991 | Poor | 84/314 R |
| 5,033,351 | A | 7/1991 | Nomura | |
| 5,072,643 | A | 12/1991 | Murata | |
| 5,804,753 | A * | 9/1998 | Speer | 84/269 |
| 5,955,688 | A | 9/1999 | Cook | |
| 6,051,766 | A * | 4/2000 | Taylor | 84/293 |
| 6,087,568 | A | 7/2000 | Seal | |
| 6,100,458 | A | 8/2000 | Carrington et al. | |
| 6,107,552 | A | 8/2000 | Coomar et al. | |
| 6,350,940 | B1 * | 2/2002 | Upchurch et al. | 84/314 R |
| 6,369,306 | B2 | 4/2002 | Chapman | |
| 6,538,183 | B2 | 3/2003 | Verd | |
| 6,657,113 | B2 | 12/2003 | Herman | |
| 7,173,175 | B2 * | 2/2007 | Shaffer | 84/314 R |
| 7,385,125 | B2 * | 6/2008 | Motsenbocker | 84/292 |
| 7,427,707 | B2 * | 9/2008 | Shaffer | 84/464 A |
| 2006/0101980 | A1 | 5/2006 | Jones | |
| 2006/0213358 | A1 * | 9/2006 | Motsenbocker | 84/731 |
| 2008/0190264 | A1 * | 8/2008 | Jones et al. | 84/314 R |
| 2008/0236373 | A1 * | 10/2008 | Motsenbocker | 84/731 |

* cited by examiner

UNITARY FINGERBOARD AND METHOD OF MAKING SAME

CROSS-REFERENCE TO RELATED APPLICATIONS

This application is a continuation-in-part of U.S. patent application Ser. No. 11/273,682 filed on Nov. 14, 2005, entitled "HEAD ASSEMBLY FOR STRING INSTRUMENTS AND METHOD FOR MANUFACTURING STRING INSTRUMENTS," the entire contents of which are herein incorporated by reference, which claims the benefit of U.S. Provisional Patent Application Ser. No. 60/627,567 filed on Nov. 12, 2004, the entire contents of which are incorporated herein by reference.

BACKGROUND OF THE INVENTION

1. Field of the Invention

The present invention relates generally to a stringed instrument, and more particularly, to a stringed instrument having a neck defining a fingerboard and a substrate, and a method of manufacturing the stringed instrument.

2. Description of Related Art

A large number of stringed instruments have a main body that includes a head assembly connected to a tail by a neck. Typically, strings extend from the head assembly to the tail, and one end of each string is engaged by a rotatable peg, which in turn is rotated to adjust the tension on the string.

Many such stringed instruments utilize fingerboards, which are defined by the necks of the instruments. Fingerboards, also known as fretboards, allow a player to control the tone and sound of an instrument. Typically, fingerboards include a substrate, which is constructed of a material, such as wood, that is laminated or otherwise attached to or defined by the neck of the instrument. Raised strips of hard material, such as metal, composite material, stone, treated wood, or glass, are then individually placed into position on the exposed side of the substrate to form frets. Sometimes, part of the substrate is removed between the frets to allow the player to touch the string only, requiring the player to use less finger pressure than would otherwise be required.

Frets are typically installed individually, with precision, on each stringed instrument produced, which results in significant production efforts and costs. The frets must be placed at a proper height and with a particular distance between each fret. Precise placement of each fret upon the substrate is difficult and requires time and precision skills. Moreover, each fret does not always fit within its place on the substrate of the neck because of improper formation of the fret or warping or other irregularities in the neck. Frets and the fingerboard also tend to wear with use, and because the process of applying frets to the neck of a stringed instrument is labor intensive, the cost of replacing the fingerboard often exceeds the cost of replacing the instrument itself.

BRIEF SUMMARY OF THE INVENTION

Embodiments of the present invention provide a fingerboard that is cost-effective to produce and that allows for the frets and/or the fingerboard to be replaced on the neck of a used instrument without having to replace the instrument itself. The method of the present invention may reduce production times, costs, and efforts, as well as create a consistently reliable and accurate fingerboard that can be placed on the neck of most stringed instruments. Moreover, precise mass production may be used because of the decrease in labor intensity when applying the method of the present invention.

In one aspect of the present invention, a stringed musical instrument is provided that has a head assembly and a tail. An elongate neck, which defines a fingerboard having a surface layer and a substrate, extends from the head assembly to the tail. The surface layer has an exposed surface formed of sheet metal deformed to unitarily define a plurality of frets thereon. Several strings extends from the head assembly along the neck and adjacent to the fingerboard.

In another aspect of the present invention, a stringed musical instrument is provided, which also has a head assembly, a tail, and an elongate neck extending from the head assembly to the tail. The neck defines a fingerboard having a surface layer and a substrate. The surface layer includes an exposed surface unitarily defining a plurality of frets thereon. Each fret forms a peak, and the surface layer defines a plurality of troughs separated by the peaks. Each trough has a single arcuate shape extending between each peak. Several strings extend from the head assembly along the neck and adjacent to the fingerboard.

In yet another aspect of the present invention, a method for forming a fingerboard for a neck of a stringed musical instrument is provided. The method includes steps of providing a mold having a series of projections separated by depressions and a sheet of deformable material. The sheet of deformable material is provided over at least of portion of the projections and depressions. The method also includes pressing the sheet of deformable material against the mold to form a series of raised frets in the deformable material and attaching the sheet of deformable material to a substrate of the neck of the stringed musical instrument to form a fingerboard on the stringed instrument.

Further objects, features and advantages of this invention will become readily apparent to persons skilled in the art after a review of the following description, with reference to the drawings and claims that are appended to and form a part of this specification.

BRIEF DESCRIPTION OF THE DRAWINGS

The drawings described herein are for illustration purposes only and are not intended to limit the scope of the present disclosure in any way.

DETAILED DESCRIPTION OF THE INVENTION

The following description is merely exemplary in nature and is not intended to limit the present disclosure, application, or uses.

The present invention generally provides a stringed instrument having a head assembly, a tail, and a neck extending therebetween. The neck defines a fingerboard that is cost-effective to produce, such that a new surface layer of a fingerboard may be easily manufactured and applied to replace an existing, worn-out fingerboard of a used instrument.

Figure 1:
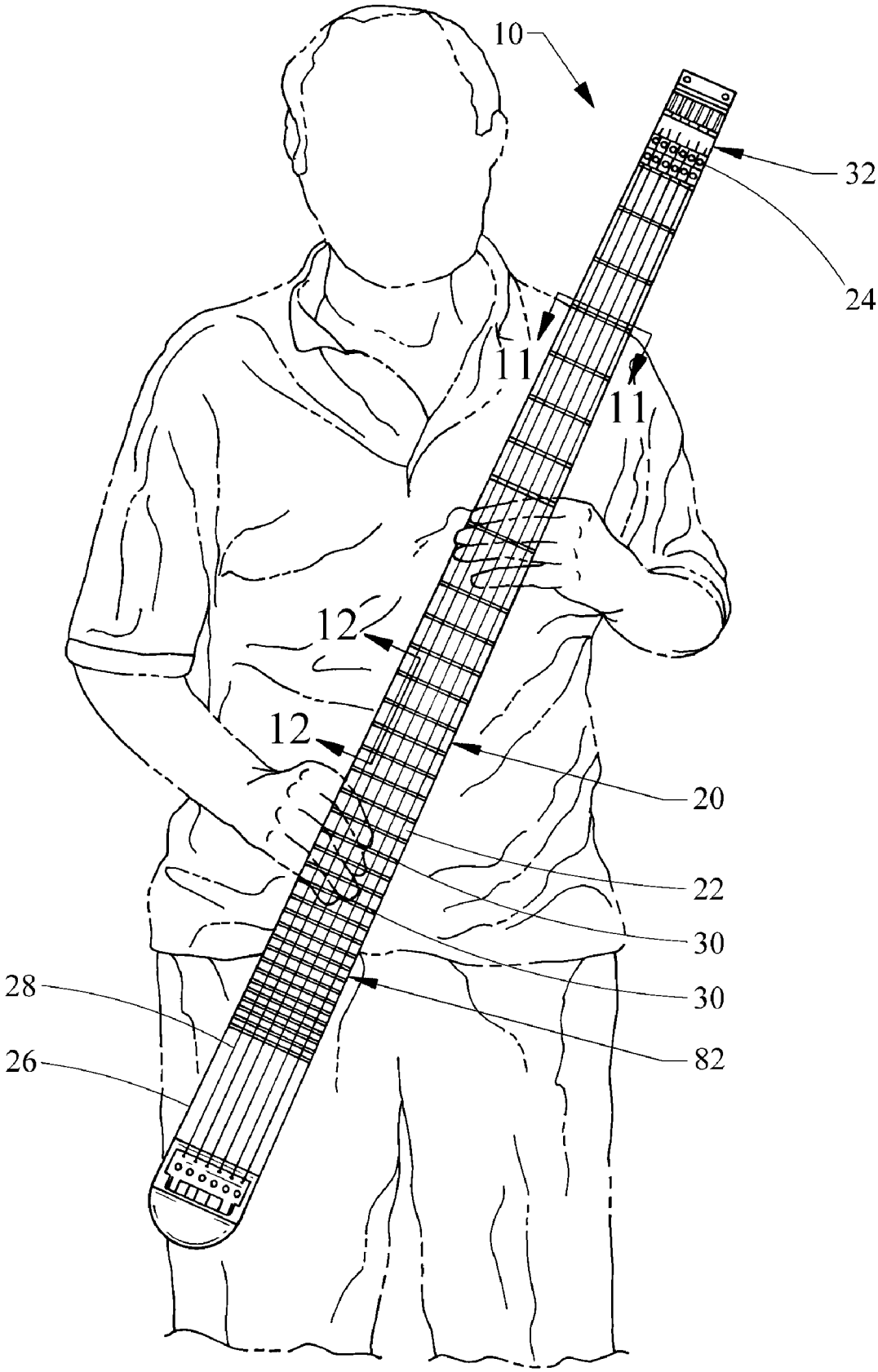
FIG. 1 is a is a silhouette of a musician holding a stringed instrument constructed in accordance with the teachings of the present invention.

Turning now to the FIGURES, FIG. 1 depicts a musician 10 holding a guitar-like instrument 20 constructed in accordance with the teachings of the present invention. The instrument 20 is a stringed musical instrument, which could an electric guitar, by way of example, although it will be recognized by those skilled in the art that the present invention may be applied to any stringed instrument.

The instrument 20 generally includes a main body, including an elongate neck 22 extending between a head 24 and a tail 26. Any number of strings 28 may be strung longitudinally across the neck 22 adjacent thereto, spanning from the head 24 to the tail 26. The head 24 has a head assembly 32, which generally includes a plurality of adjustable nuts engaging the strings 28. A tailpiece, numerous of which are well known in the art and can be readily purchased, is attached to the tail 26 of the main body. This may be accomplished through screws, adhesives or other clamping mechanisms. As with the tailpiece, the head assembly 32 may be connected in any preferred manner such as by adhesive, welding, clamps or screws or any fastening means.

A top surface of the neck 22 defines a fingerboard 82 having a plurality of frets 30 extending laterally across the body 22. As is known in the art, the instrument 20 is preferably an electric, stringed instrument that requires amplification, such as an electric guitar. It is played by striking, hammer on/pull off technique, strumming or a combination of the foregoing. It can be played in numerous positions, such as being supported on the body, or a stand, or an end pin such as in a cello. It can be held with a strap, knee bar, or on a belt hook or in one's lap.

Figure 2:
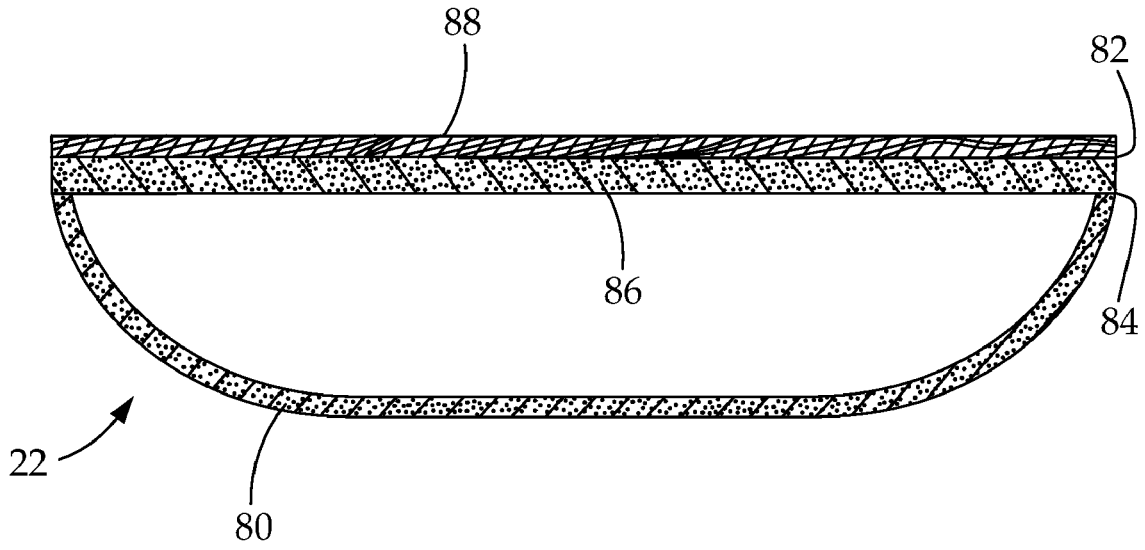
FIG. 2 is a cross-sectional view taken about the line 11-11 in FIG. 1.

As shown in FIG. 2, the neck 22 of the instrument 20 defines a fingerboard 82 and a shell 80 comprising a substrate 86. The shell 80 generally includes curved sidewalls which extend up to and engage a bottom surface of the fingerboard 82 and form a joint 84. It will be recognized that the sidewalls need not be curved or may extend generally vertically and only a small radius (or no radius) provided at the corners. Both the fingerboard 82 and the shell 80 may be constructed of a composite material. A preferred composite material is carbon fiber impregnated with a resin such as an epoxy. In addition, or in the alternative, the fingerboard 82 may be partially or fully constructed of a malleable material, such as steel, aluminum, or any other suitable malleable material. The joint 84 may be formed by using an epoxy, although other techniques such as vibrational welding, ultrasonic welding, and/or clamps or other fastening mechanisms or techniques may be readily employed. The joint 82 may be simply formed with an epoxy to connect the fingerboard 82 and shell 80, although other connection structures may be used as well as connection processes such as welding techniques. For example, if the fingerboard substrate 86 and shell 80 were constructed of a thermo plastic or thermoformable polymer, welding the two pieces together could easily be accomplished through heat or appropriate vibration welding techniques.

By forming the shell 80 of a composite material and the fingerboard 82 of a composite material or a metal, the neck 22 has sufficient rigidity and torsional strength that additional supporting structures (e.g. a truss rod) are not needed. Thus, the neck 22 may generally be hollow and therefore the instrument 20 is very lightweight.

It will also be recognized that the instrument, and in particular the fingerboard 82 and shell 80, may be constructed of a composite material or other material which is provided on both sides of a core (such as cores of wood, foam or other known core materials) to provide a sandwiched construction. This will provide even further strength without requiring a truss rod for rigidity of the instrument.

Figure 3:
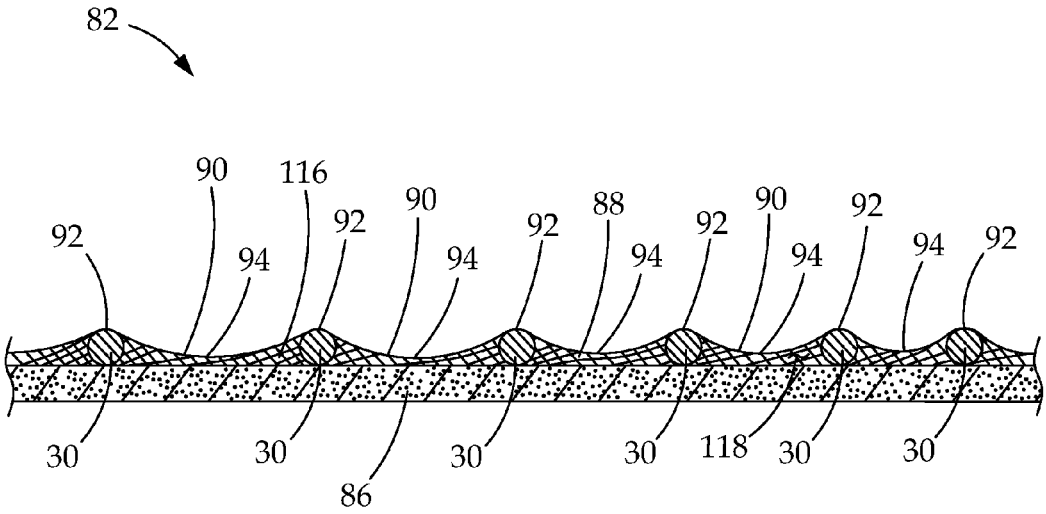
FIG. 3 is a cross-sectional view taken about the line 12-12 in FIG. 1.

As seen in FIG. 3, the fingerboard 82 may include a substrate 86 as previously discussed, as well as an additional surface layer 88. The surface layer 88 may be constructed purely of an epoxy or other adhesive or polymer which provides a smooth surface that while sensitive to the touch of the musician 10, has sufficient durability to handle the abrasion from strings 28 and the fingers of the musician 10. In addition, or in the alternative, the surface layer 88 may be formed of a deformed metal sheet. The frets 30 may be constructed of a stainless steel material and may be round, although numerous other shapes and materials may be used for the frets 30 as is known in the art.

Figure 4:
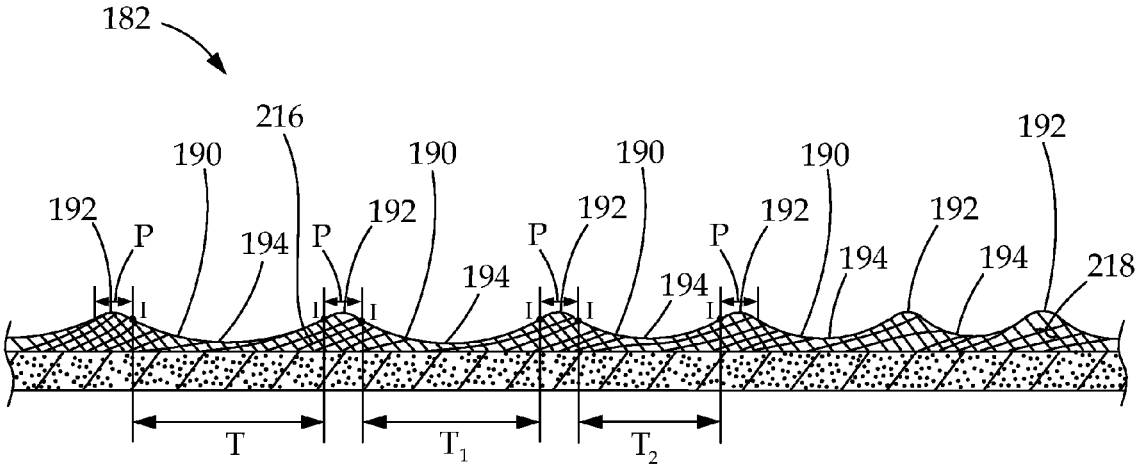
FIG. 4 is a cross-sectional view of another variation of the neck of FIG. 1, taken along the line 12-12 in FIG. 1.

With reference to FIG. 4, in some embodiments, the frets 30 may be omitted, as the surface layer 188 itself may provide enough rigidity such that the peaks 192 of the surface layer 188 form frets unitarily with the troughs 194, or low sections, of the surface layer 188. In all other respects, the fingerboard 182 having no separate frets 30 may be similar to a fingerboard 82 having frets 30. For example, the fingerboard 182 may include a substrate 186 having a surface layer 188 disposed thereon.

As shown in FIG. 3, the exposed surface of the surface layer 88 preferably includes a plurality of peaks and troughs, or stated another way includes a plurality of scallops 90 formed between each of the frets 30. The scallops 90 may provide optimal feel for a musician 10, although the shape of the exposed surface of the fingerboard 82 may take any shape depending on an individual's preference. A portion of each fret 30 may be left exposed above the layer 88, or in some embodiments, the frets 30 may be omitted. For example, with reference to FIG. 4, the frets 30 are omitted, and the surface layer 188 forms a rigid surface with the peaks 192 of the surface layer 188 serving as frets. The peaks 192 are separated by scallops 190, which may be in the form of troughs 194.

As shown in FIG. 4, the fingerboard 182, or fingerboard surface layer 188, includes an exposed surface unitarily defining a plurality of frets in the form of peaks 192 thereon. In other words, each fret forms a peak 192, and the fingerboard 182 or fingerboard surface layer 188 defines a plurality of troughs 194 separated by the peaks 192. Each trough 194 preferably has a single arcuate shape extending between each peak 192. Thus, the surface layer 188 of the fingerboard 182 may be a unitary structure including frets, in the form of peaks 192, which are formed unitarily with the rest of the fingerboard 182, having scallops 190, or single curves, in the form of troughs 194 separating each fret, or peak 192. The curved shape of the troughs 194 permits the player to play the instrument with little finger resistance; however, removing of material between the peaks 192, or frets, is not required, since the scalloped shape of the troughs 194 is formed unitarily with the rest of the fingerboard surface layer 188.

Each peak 92, 192 has a convex shape with respect to the exposed side of the fingerboard 182 and each trough 94, 194 has a concave shape with respect to the exposed surface of the fingerboard 182. The concave and convex shapes are separated by points of inflection 1.

Referring to FIG. 4, each peak 192 extends a distance P along the fingerboard 182. Preferably, each peak 192 extends the same distance P, resulting in frets having a uniform width; however, it should be understood that each peak 192 could alternatively extend different distances $P_1$, $P_2$, $P_3$, etc., resulting in frets having different widths along the fingerboard 182.

The troughs 194 separate each peak 192, the troughs 194 being defined as beginning at the end of each peak 192, at a point of inflection I, and extending along a single curve to the beginning of the next peak 192 at another point of inflection I. Preferably, the troughs 194 do not have lengths equal to each other, as the troughs 194 are generally spaced at increasing distances from each other along the fingerboard 182 toward to the head assembly 32. Therefore, one trough 194 extends a distance T, while the next trough 194 extends a distance $T_1$, while the next consecutive trough 194 extends a distance $T_2$ along the fingerboard 182. It should be understood, with reference to FIG. 4, that $T>T_1>T_2$.

Furthermore, the peaks 192 generally extend a shorter distance along the fingerboard 182 than do the troughs 194, at least along a top half of the fingerboard 182, the top half being adjacent to the head assembly 32. Thus, for a portion of the fingerboard 182, the peaks 192 extend a distance P that is shorter than the distance T, $T_1$, $T_2$ that the troughs 194 extend. In other words, $P<T$, $P<T_1$, and $P<T_2$. The bottom half of the fingerboard 182 is located adjacent to the tail 26. On the bottom half of the fingerboard 182, the peaks 192 closest to the tail 26 are relatively close together, such that the peaks 192 may extend a distance P that is longer than the distance that the troughs 194 extend. In other words, in a section of the fingerboard 182 that is relatively close to the tail 26, $P>T$. However, it should be understood by one having ordinary skill in the art that the peaks 192 and troughs 194 could have other relationships and distances, without falling beyond the spirit and scope of the present invention.

The description of the peaks 192 and troughs 194, although shown with respect to FIG. 4, may also apply to the embodiment of FIG. 3 and any other embodiment of the present invention. Furthermore, for any embodiment of the neck within the present invention, the fingerboard surface layer 88, 188 may be attached to the substrate 86, 186 with an adhesive, such as resin 116, 216, the resin 116, 216 filling the space 118, 218 between the substrate 86, 186 and the peaks 92, 192. With respect to FIG. 4, the resin 216 fills in the blank space 218 between the substrate 186 and the frets, or peaks 192.

Figure 5:
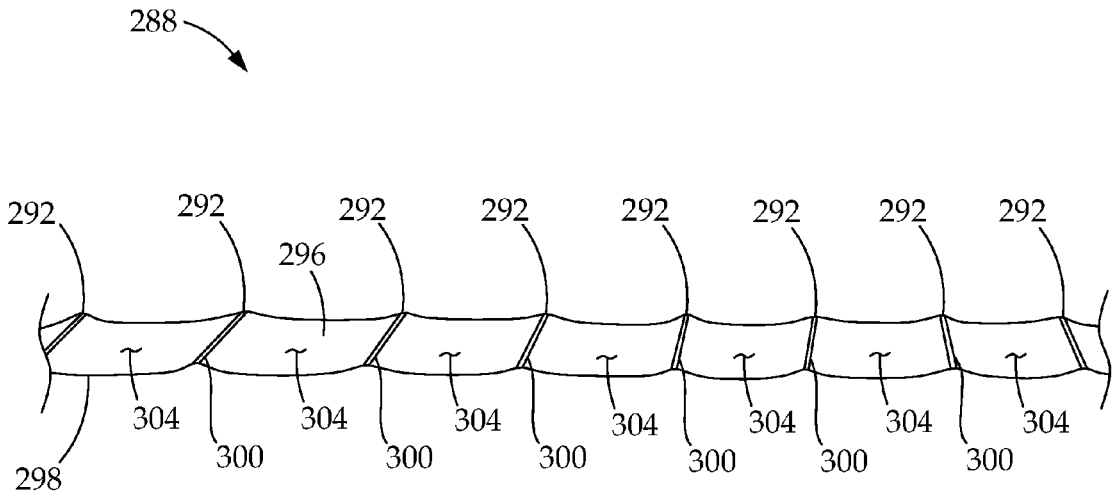
FIG. 5 is a perspective view of the fingerboard of FIG. 4.
Figure 6:
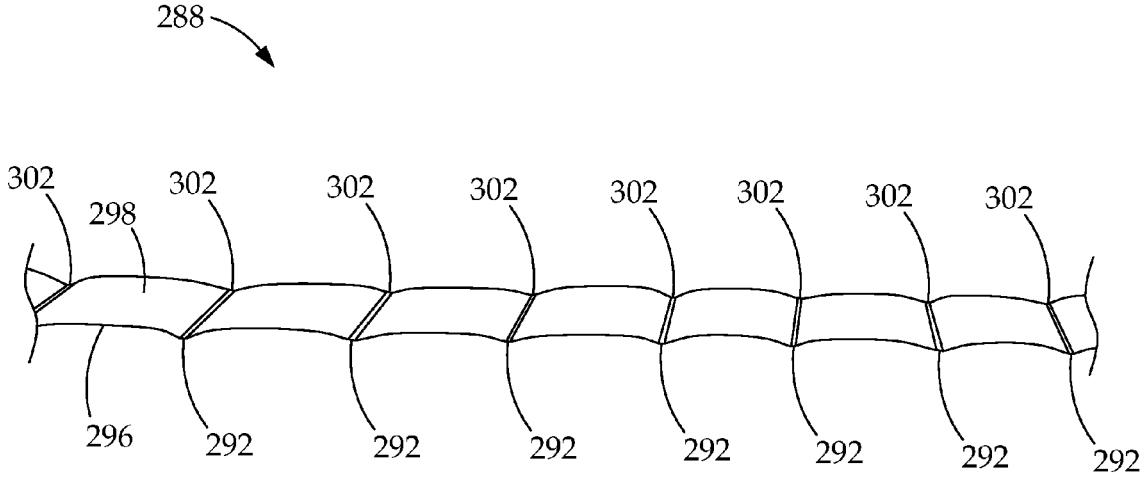
FIG. 6 is a perspective view of the fingerboard of FIGS. 4-5.

Now, with reference to FIGS. 5 and 6, one variation of a surface layer 288 of a fingerboard will be described. The surface layer 288 may be used in conjunction with the instrument 20 having a head assembly 32, a tail 26, strings 28, and an elongate neck 22 defining a fingerboard 82, 182 having a substrate 86, 186, as hereinbefore described. The surface layer 288 has a top side 296 to form an exposed surface of the fingerboard 82, 182 and a back side 298, which is configured to be attached to the substrate 86, 186.

The surface layer 288 is formed of sheet metal deformed to unitarily define a plurality of frets 292 thereon. In other words, rather than being formed of separate and distinct components, the frets 292 are formed unitarily with the surface layer 288 of the fingerboard 82, 182. Thus, the frets 292 are each connected by, and indeed formed unitarily with, other portions of the sheet metal surface layer 288. Each fret 292 defines a raised portion 300 on the exposed surface, or top side 296, of the surface layer 288. The back side 298, or back surface, has a plurality of concave portions 302 corresponding to the raised portions 300 on the exposed surface, or top side 296.

With reference to the top side 296, or exposed surface, of the surface layer 288 (FIG. 5), the frets 292, which define raised portions 300, are separated by concave scalloped portions 304. Each concave scalloped portion 304 has a single arcuate shape extending between each raised portion 300. Thus, the surface layer 388 has seamless, smooth frets 292 unitarily formed with scalloped portions 304 along its length. Each raised portion 300 has a peak, and in some variations, the peaks have a planar portion that is parallel to a planar mounting surface of the substrate 86, 186 to allow for easier playing of the instrument. However, it should be understood that the raised portions 300 could have configurations other than a planar portion, without falling beyond the spirit and scope of the present invention.

Figure 7:
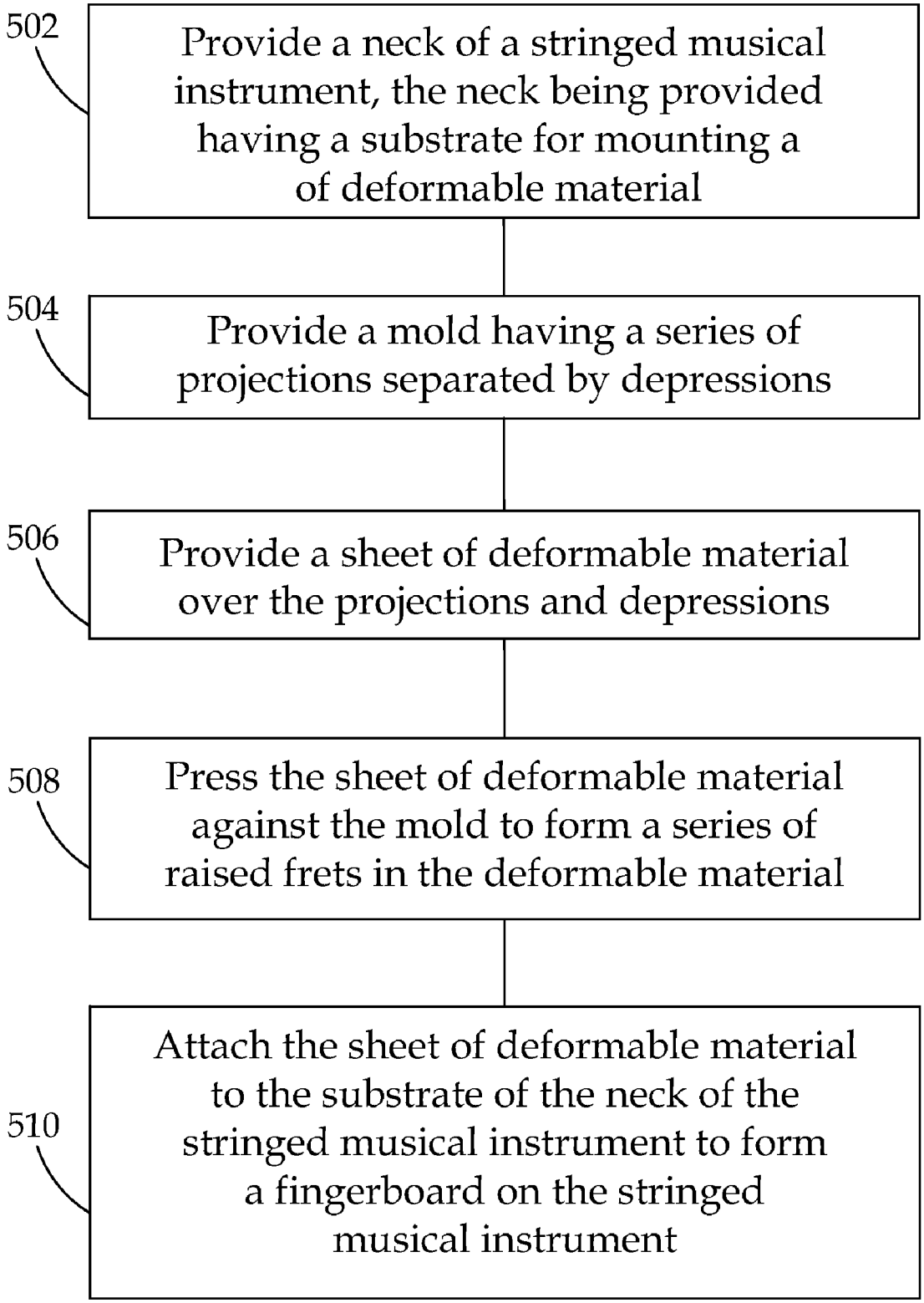
FIG. 7 is a block diagram of a method in accordance with principles of the present invention.
Figure 8A:
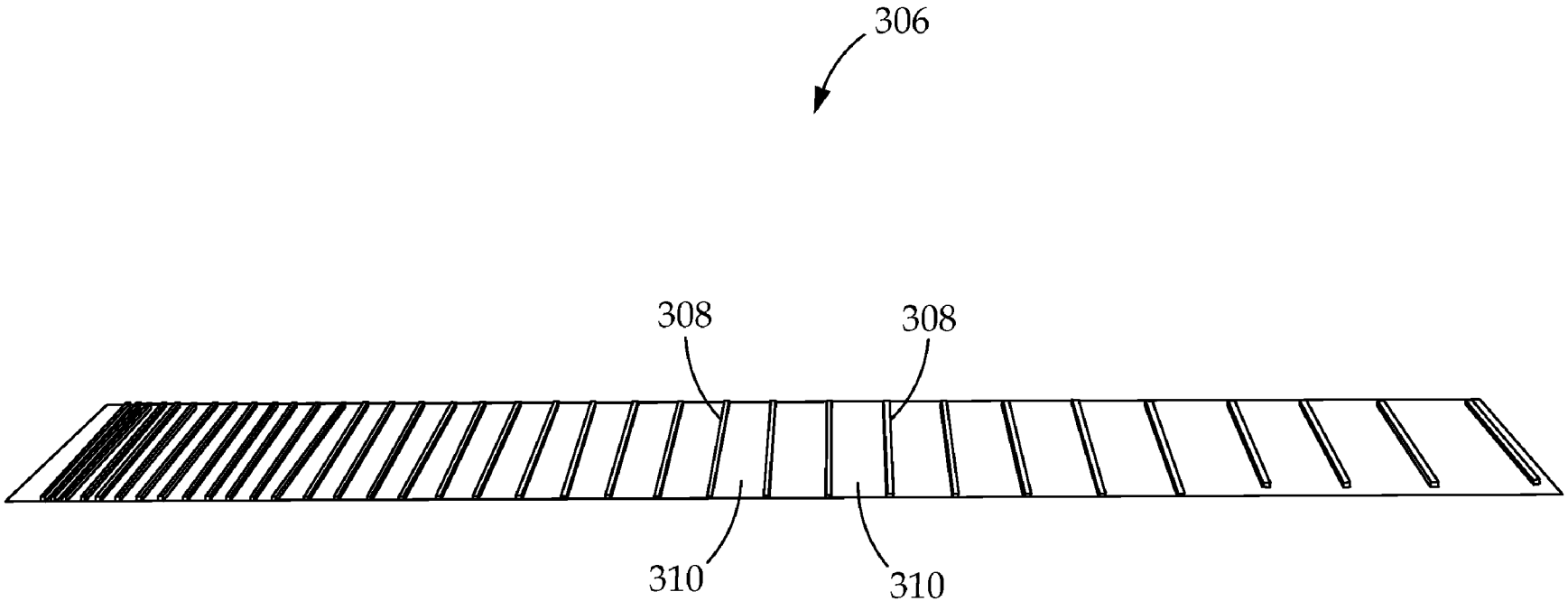
FIG. 8*a* is a perspective view of a mold according to the principles of the present invention.
Figure 8B:
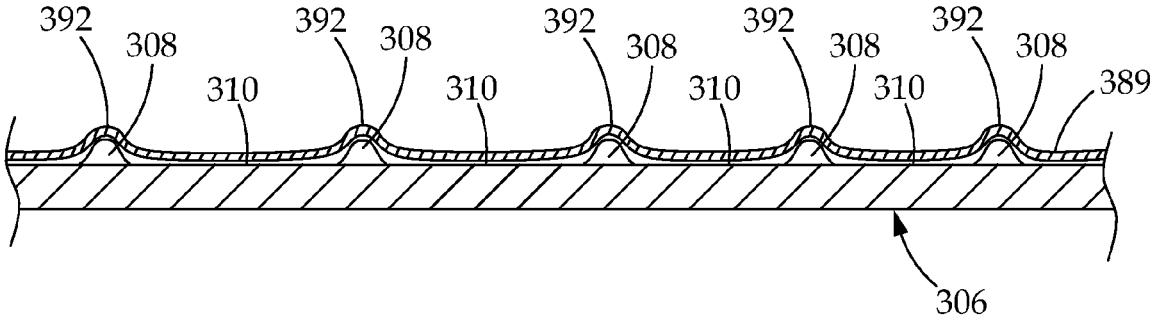
FIG. 8*b* is a cross-sectional view of the mold of FIG. 8*a*, and a surface layer of a fingerboard according to the principles of the present invention.

With reference to FIG. 7, a method 500 for forming a fingerboard 82, 182 for a neck 22 of a stringed musical instrument 20 is also provided herein. The method 500 includes a step 502 of providing a neck 22 of the stringed musical instrument 20, the neck 22 being provided having a substrate 86, 186 for mounting a sheet of deformable material 389. The method 500 also includes a step 504 of providing a mold 306 (See FIGS. 8*a* and 8*b*), such as a male mold 306 having a series of projections 308 separated by depressions 310. The projections 308 may be rods or bars, for example, formed of a hard material such as steel, stone, glass, or any other hard material, having the desired shape of the frets (such as the convex curvature as shown and described in FIG. 8*b* or the rectangular shape of FIG. 13). In some embodiments, the projections 308 may be formed individual "frets," such as those shown in FIG. 3. In other words, instead of using the frets 30 as part of the instrument 20, they could be used to manufacture the mold 308. It should be understood that any shape and material of frets 30 could be used to manufacture the mold 308.

The method 500 further includes a step 506 of providing a sheet of deformable material 389 over at least of portion of the projections 308 and depressions 310. The sheet of deformable material 389 is preferably an anodized metal, such as aluminum for hardness and wear, or work-hard stainless steel. The sheet of deformable material 389 could alternatively be formed of thermal-formed or thermal-formable materials and/or composites, or any flexible or stampable material. In some forms of the invention, it is preferable to roughen the back side 406 of the sheet of deformable material 389 to allow for better adhesion to the substrate 386, which is described further below.

Figure 9:
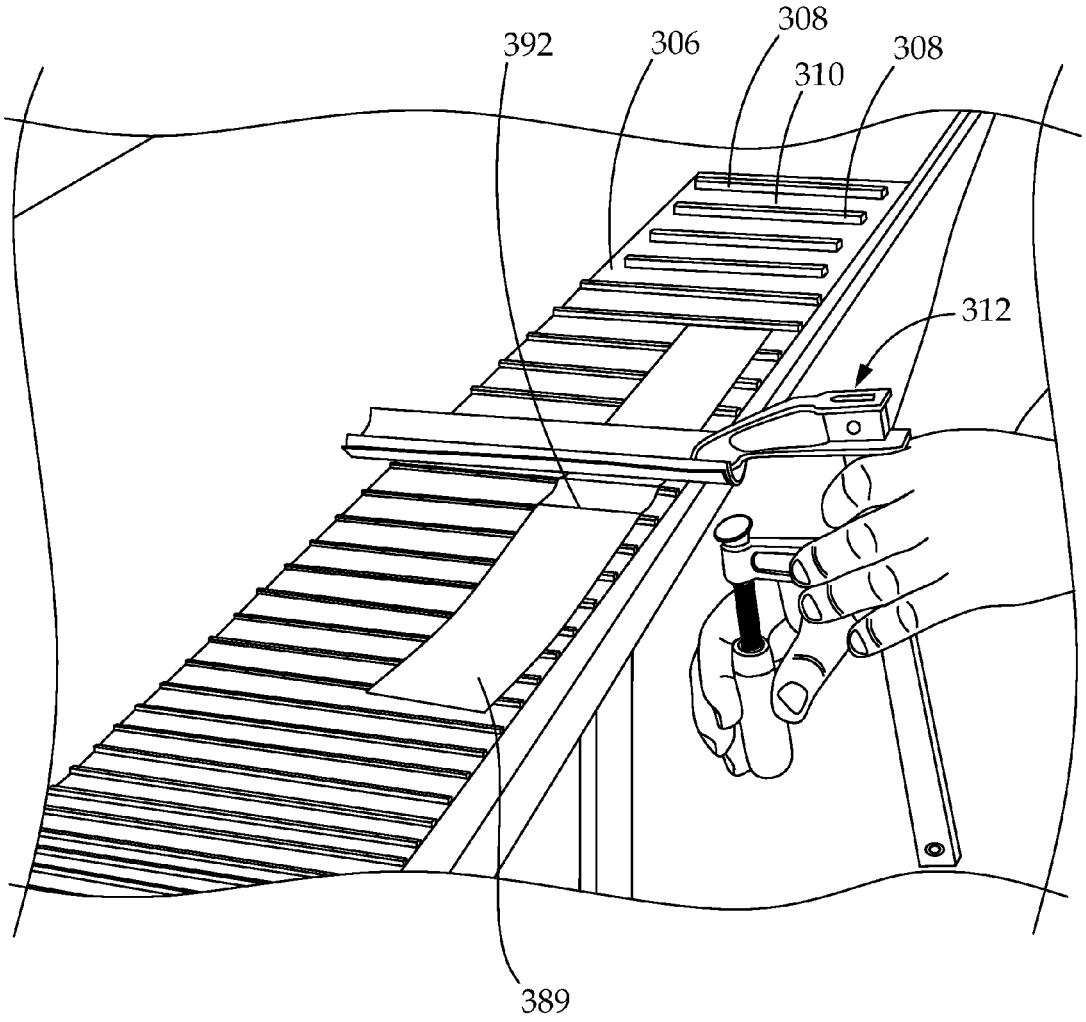
FIG. 9 is a perspective view of a mold, a sheet of deformable material, and a clamping device according to the principles of the present invention.
Figure 10:
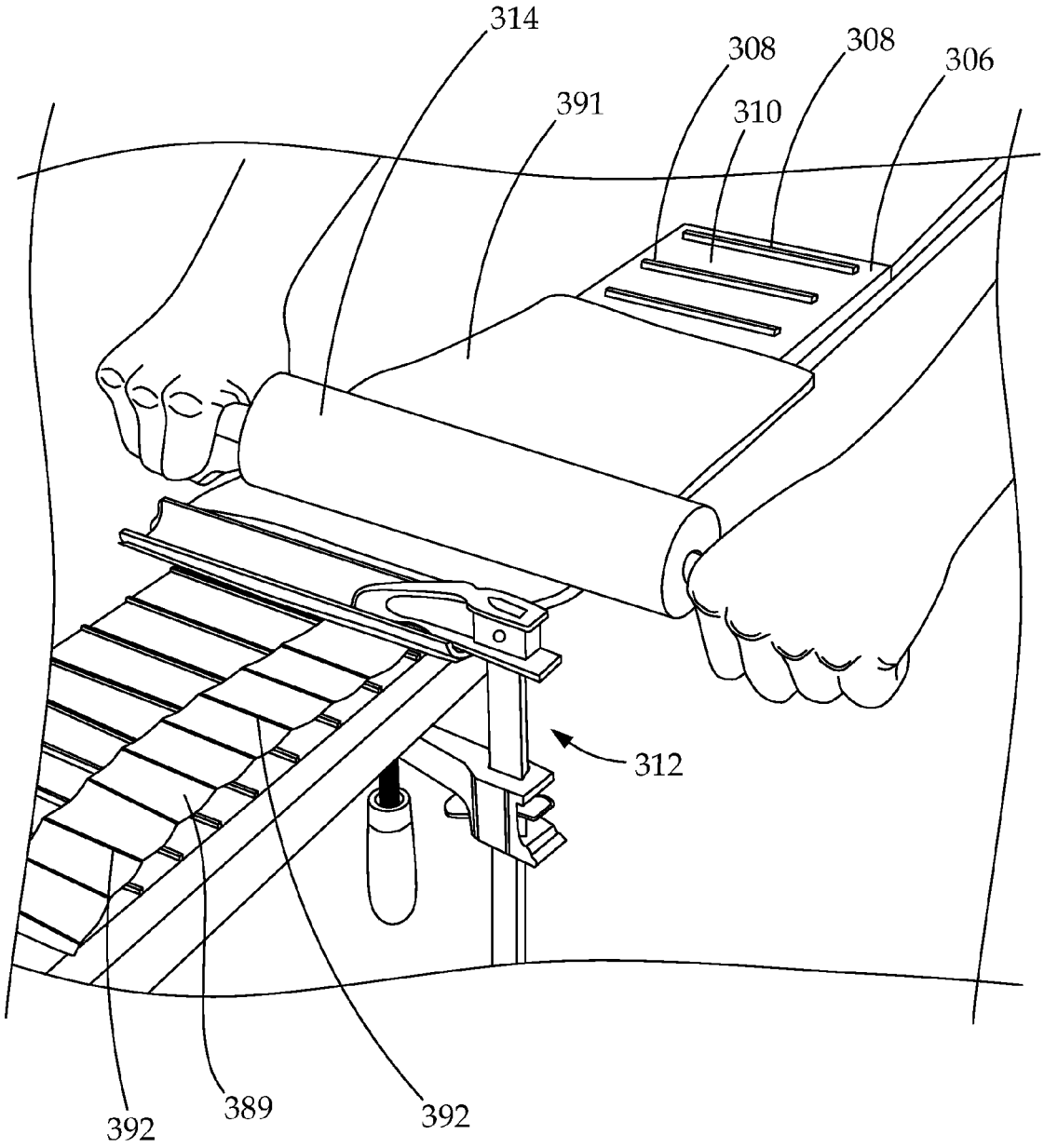
FIG. 10 is a perspective view of a mold, a sheet of deformable material, a clamping device, and a rolling device according to the principles of the present invention.

To form the sheet of deformable material 389 into a surface layer 88, 188, 288 of a fingerboard 82, 182, the method 500 includes a step 508 of pressing the sheet of deformable material 389 against the mold 306 to form a series of raised frets 392 in the deformable material 389. With reference to FIGS. 9 and 10, a clamping device 312 may be used to clamp the sheet of deformable material 389 to the mold 306 and/or to form all or a portion of the frets 392 thereon. With reference to FIG. 10, a rolling device 314 may also be used to form the frets 392 on the sheet of deformable material 389. Preferably, a piece of neoprene, foam, or other protective material 391 is placed between the rolling device 314 and the sheet of deformable material 389. The sheet of deformable material 389 is preferably pressed until the depth of each fret 392 is uniform. The frets 392 take the shape of the projections 308 as the sheet of deformable material 389 is pressed against the mold 306.

Other manners of pressing the sheet of deformable material 389 to form frets 392 thereon may also or alternatively be used, such as stamping or hydroforming, as one having ordinary skill in the art would understand. The frets 392 may be stamped with a compound radius to allow precise installation on the instrument's neck 22. Moreover, the dense end of the surface layer 388, formed from the sheet 389, which is to be used near the tail 26, may require hand forming of the frets 392. In some forms of the invention, a mat, such as a rubber mat by way of example, may be placed over the sheet of deformable material 389 and the mold 306, and many tons of pressure may be applied over the sheet of deformable material 389 and mold 306. In some forms of the present invention, the applied pressure may be in range of 20 to 30 tons, however, higher or lower amounts of pressure may be applied depending on the materials, dimensions, and other parameters selected.

Another step 510 of the method 500 includes attaching the sheet of deformable material 389 to the substrate 386 of the neck 22 of the stringed musical instrument 20 to form a fingerboard 382 on the stringed musical instrument 20. In some forms of the invention, it is preferable to roughen the substrate 386 to form a roughened portion of the substrate 386 corresponding to the previously roughened back side 406 of the sheet of deformable material 389; however, it should be understood that roughening of the substrate 386 and the sheet of deformable material 389 is optional. Then, the step 510 of attaching the sheet of deformable material 389 to the substrate 386 may include attaching the back side 406 of the sheet of deformable material 389 to the roughened portion of the substrate 386. The substrate 386 preferably defines a planar mounting surface 387 for mounting the sheet of deformable material 389. After the sheet of deformable material 389 is mounted to the substrate 386, it forms the surface layer 388 of the fingerboard 382.

Figure 12:
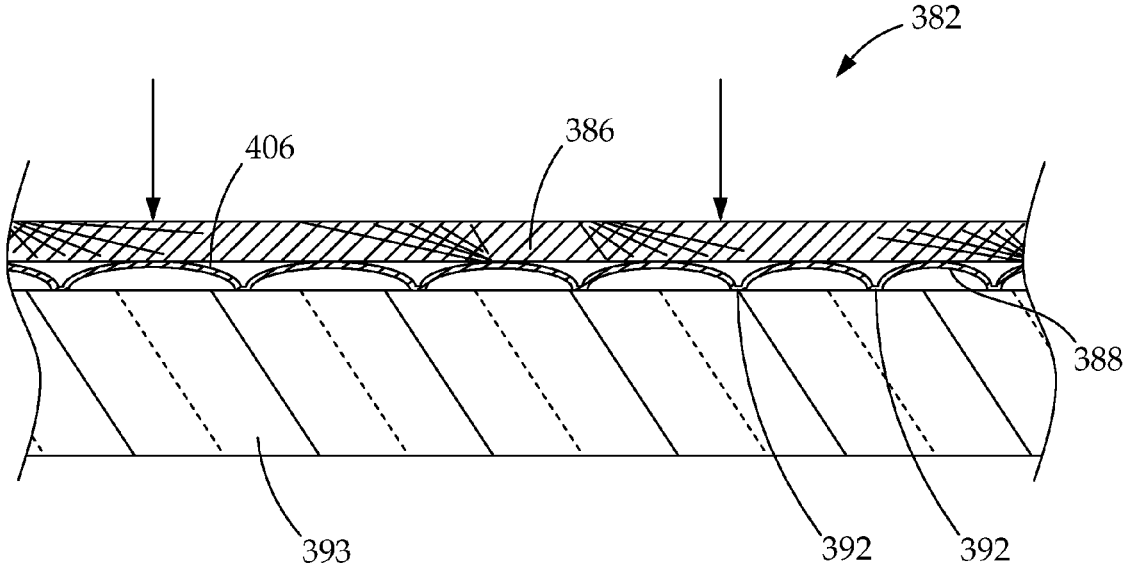
FIG. 12 is a cross-sectional view of a fingerboard and a AA Grade surface plate in accordance with the principles of the present invention.

With reference to FIG. 12, the present invention, however, does not require that the substrate 386 be perfectly planar. The surface layer 388 may be attached to the substrate 386 by placing the surface layer 388 on a flat AA Grade surface plate 393 and attaching the substrate 386 to the back side 406 of the surface layer 388. Such a method of assembling the surface layer 388 and the substrate 386 results in the frets 392 having uniform height on the fingerboard 382. In other words, the flat AA Grade surface plate 393 ensures planarity of the frets 392. Thus, the frets 392 are accurately placed, despite any irregularities in the neck 22. Adhesive material, described below, may simply fill in any irregularities or gaps, and pressure may be applied to the substrate 386 until the adhesive material cures. However, in a preferred form, the substrate 386 is provided as flat within 0.001 inch and is checked on a AA Grade surface plate 393 prior to application of the sheet of deformable material 389 to the substrate 386.

Thus, the step 510 of attaching the sheet of deformable material 389 to the substrate 386 of the neck 22 includes attaching the sheet of deformable material 389 with an adhesive material, such as an epoxy resin 416. As described above, the sheet of deformable material 389 is laid flat on the AA Grade surface plate 393 having AA Grade planarity, with the surface layer 388 forming the support and the back side 406 exposed. Epoxy resin 416 is added to the back side 406 of the surface layer 388 and the substrate 386, and the substrate 386 is laid over the back side 406 of the surface layer 388. Pressure is applied to the substrate 386 to push the substrate 386 and the surface layer 388 against the AA Grade surface plate 393. The adhesive material 416 fills in the space 418 between the substrate 386 and a back side 406 of the sheet of deformable material 389. The epoxy resin 416 is then preferably cured until firm. Thus, the back side 406 of the surface layer 388 is attached to the substrate with an adhesive, the adhesive filling the plurality of concave portions 402 on the back side 406 of the surface layer 388. In other words, the adhesive, such as epoxy resin 416, fills the space 418 between the planar mounting surface 387 and the frets 392. Pressing the AA Grade surface against the exposed side of the surface layer 388 during application of the substrate 386 causes the frets 392 to have a uniform height along the fingerboard 382, despite any irregularities that may be present on the substrate 386.

The method 500 may include further steps, such as cutting the sheet of deformable material 389 to a size not larger than the size of the substrate 386 of the neck 22 of the stringed musical instrument 20 and/or shortening the edges of the sheet of deformable material 389 until the sheet of deformable material 389 is not larger than the substrate 386 of the neck 22 of the stringed musical instrument 20. In addition, the method 500 may include embossing or otherwise decorating the sheet of deformable material 389.

Figure 11:
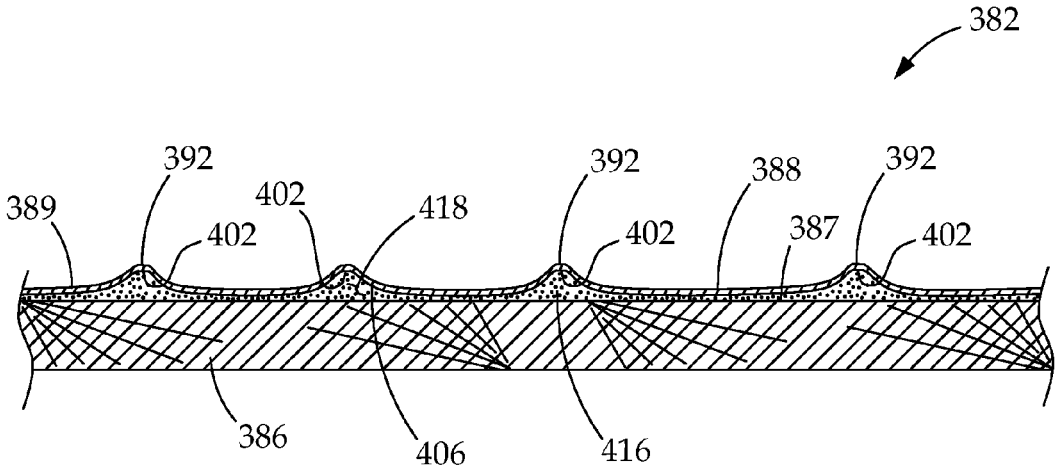
FIG. 11 a cross-sectional view of yet another variation of the neck of FIG. 1, taken along the line 12-12 in FIG. 1.
Figure 13:
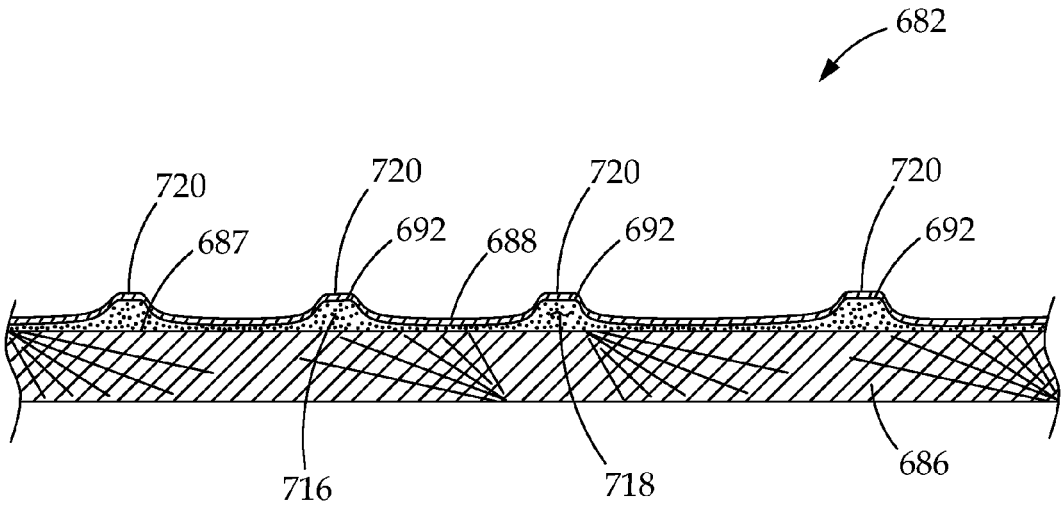
FIG. 13 is a cross-sectional view of still another variation of the neck of FIG. 1, taken along the line 12-12 in FIG. 1.

With reference now to FIG. 13, another fingerboard 682 is illustrated, having a substrate 686 and a surface layer 688. The surface layer 688 may be formed as described above; however, the surface layer 688 has frets 692 that have a flat top portion 720 that is parallel to the planar mounting surface 687 of the substrate 686. Similarly to the fingerboard 382 of FIG. 11, adhesive such as epoxy resin 716 fills in the space 718 between the frets 692 and the planar mounting surface 687 of the substrate 686 and attaches the surface layer 688 to the substrate 686.

Figure 14:
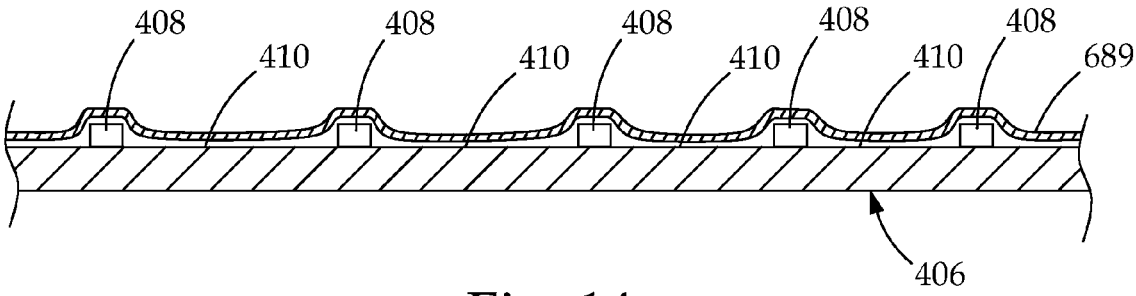
FIG. 14 is a cross-sectional view of a mold and a surface layer of a fingerboard in accordance with the principles of the present invention.

With reference to FIG. 14, the surface layer 688 of FIG. 13 is formed from a sheet of deformable material 689 that is pressed over a male mold 406 having a series of projections 408 separated by depressions 410. The projections 408 are rectangular in shape to provide for the flat top portion 720 of the frets 692.

Preferably, the surface layer 88, 188, 288, 388, 688 of the present invention is formed of work-hardened material(s) or having treatments such as hard anodizing, to provide a fingerboard having a long life before wear occurs.

As a person skilled in the art will readily appreciate, the above description is meant as an illustration of implementation of the principles this invention. This description is not intended to limit the scope or application of this invention in that the invention is susceptible to modification, variation and change, without departing from the spirit of this invention, as defined in the following claims.

We claim:

1. A stringed musical instrument having a head assembly and a tail, the stringed musical instrument comprising:

an elongate neck extending from the head assembly to the tail, the neck defining a fingerboard having a substrate and a surface layer, the surface layer comprising an exposed surface formed of sheet metal deformed to unitarily define a plurality of frets thereon; and a plurality of strings extending from the head assembly along the neck and adjacent to the fingerboard, each fret defining a raised portion on the exposed surface, the raised portions being separated by concave scalloped portions.

2. The stringed musical instrument of claim 1 the surface layer further comprising a back surface having a plurality of concave sections corresponding to the raised portions on the exposed surface.

3. The stringed musical instrument of claim 2, the substrate defining a planar mounting surface.

4. The stringed musical instrument of claim 3, the back surface of the surface layer being attached to the substrate with an adhesive, the adhesive filling the plurality of concave sections.

5. The stringed musical instrument of claim 1, each scalloped portion having a single arcuate shape extending between each raised portion.

6. The stringed musical instrument of claim 3, wherein each raised portion has a peak, each peak having a planar portion that is parallel to the planar mounting surface of the substrate.

7. The stringed instrument of claim 1, each raised portion having a peak, each peak having a convex shape; and each concave scalloped portion having a concave shape with respect to the exposed surface of the surface layer, the concave and convex shapes being separated by points of inflection.

8. The stringed instrument of claim 7, at least one peak extending a distance P along the fingerboard, and an adjacent concave scalloped portion extending a distance T along the fingerboard, the distance T being greater than the distance P.

9. The stringed instrument of claim 1, the surface layer being attached to the substrate with an adhesive resin, the resin filling the space between the substrate and the frets.

10. A stringed musical instrument having a head assembly and a tail, the stringed musical instrument comprising:

an elongate neck extending from the head assembly to the tail, the neck defining a fingerboard having a substrate and a surface layer, the surface layer comprising an exposed surface formed of sheet metal deformed to unitarily define a plurality of frets thereon; and a plurality of strings extending from the head assembly along the neck and adjacent to the fingerboard, substantially all of the exposed surface being directly exposed to the plurality of strings, each fret defining a raised portion on the exposed surface, the surface layer further comprising a back surface having a plurality of concave sections corresponding to the raised portions on the exposed surface, further comprising an adhesive filling the space, including the concave sections, between the substrate and the surface layer without contacting the exposed surface of the surface layer.

11. The stringed musical instrument of claim 10, each concave section having a single arcuate shape extending between each raised portion.

12. The stringed musical instrument of claim 10, each raised portion having a peak, at least one peak extending a distance P along the fingerboard, and an adjacent concave section extending a distance T along the fingerboard, the distance T being greater than the distance P.

13. A method for forming a fingerboard for a neck of a stringed musical instrument, the method comprising:

providing a neck of a stringed musical instrument, the neck being provided having a substrate for mounting a sheet of deformable material;

providing a mold having a series of projections separated by depressions;

providing a sheet of deformable material over at least of portion of the projections and depressions;

pressing the sheet of deformable material against the mold to form a series of raised frets in the deformable material;

laying the sheet of deformable material on a flat surface;

laying the substrate over the sheet of deformable material with adhesive material located between the substrate and the sheet of deformable material; and applying pressure to the substrate to attach the sheet of deformable material to the substrate of the neck of the stringed musical instrument to form a fingerboard on the neck of the stringed musical instrument.

14. The method of claim 13, further comprising roughening a back side of the sheet of deformable material and roughening the substrate to form a roughened portion of the substrate, the step of laying the substrate over the sheet of deformable material comprising laying the roughened portion of the substrate over the back side of the sheet of deformable material.

15. The method of claim 13, wherein the step of laying the substrate over the sheet of deformable material with adhesive material located between the substrate and the sheet of deformable material comprises filling in the space between the substrate and the frets with the adhesive material.

16. A method for forming a fingerboard for a neck of a stringed musical instrument, the method comprising:

providing a neck of a stringed musical instrument, the neck being provided having a substrate for mounting a sheet of deformable material;

providing a mold having a series of projections separated by depressions;

providing a sheet of deformable material over at least of portion of the projections and depressions;

pressing the sheet of deformable material against the mold to form a series of raised frets in the deformable material; and attaching the sheet of deformable material to the substrate of the neck of the stringed musical instrument to form a fingerboard on the neck of the stringed musical instrument, wherein the step of attaching the sheet of deformable material to the substrate of the neck comprises attaching the sheet of deformable material to the substrate with an adhesive material, the adhesive material filling in the space between the substrate and the frets, and wherein the step of attaching the sheet of deformable material to the substrate of the neck further comprises laying the sheet of deformable material on a AA Grade surface plate, laying the substrate over the sheet of deformable material with the adhesive material located between the substrate and the sheet of deformable material, and applying pressure to the substrate.

17. The method of claim 16, further comprising cutting the sheet of deformable material to a size not larger than the size of the substrate of the neck of the stringed musical instrument.

18. The method of claim 16, wherein the step of pressing the sheet of deformable material against the mold includes stamping the sheet of deformable material.

19. The method of claim 16, wherein the sheet of deformable material is metal.

20. The method of claim 16, further comprising shortening the edges of the sheet of deformable material until the sheet of deformable material is not larger than the substrate of the neck of the stringed musical instrument.

* * * * *